US005737849A

United States Patent [19]

Morrison et al.

[11] Patent Number: 5,737,849

[45] Date of Patent: Apr. 14, 1998

[54] RECYCLE MOISTURE EVAPORATION SYSTEM

[75] Inventors: Troy R. Morrison, Indianapolis, Ind.; Billy Joe Mullinax, Knotts Island, N.C.

[73] Assignee: Jat Enterprise Inc. of Indiana, Greenwood, Ind.

[21] Appl. No.: 753,823

[22] Filed: Dec. 2, 1996

Related U.S. Application Data

[63] Continuation of Ser. No. 573,198, Dec. 15, 1995, Pat. No. 5,579,587.

[51] Int. Cl.[6] ..... F26B 11/02

[52] U.S. Cl. ..... 34/136; 366/25; 34/137; 34/135

[58] Field of Search ..... 34/136, 140, 141, 34/142, 182; 432/105, 106; 366/25

[56] References Cited

U.S. PATENT DOCUMENTS

| | | | |
|---|---|---|---|
| 2,309,810 | 2/1943 | West | 34/13 |
| 4,298,287 | 11/1981 | McCarter, III et al. | 366/4 |
| 4,477,250 | 10/1984 | Brashears et al. | 432/3 |
| 4,540,287 | 9/1985 | Servas et al. | 366/7 |
| 4,545,700 | 10/1985 | Yates | 404/75 |
| 4,600,379 | 7/1986 | Elliott | 432/13 |
| 4,892,411 | 1/1990 | Elliott et al. | 366/25 |
| 4,913,552 | 4/1990 | Bracegirdle | 366/4 |
| 4,946,283 | 8/1990 | Musil | 366/15 |
| 4,946,307 | 8/1990 | Jakob | 404/91 |
| 5,090,813 | 2/1992 | McFarland et al. | 366/23 |
| 5,174,650 | 12/1992 | McFarland et al. | 366/23 |
| 5,188,299 | 2/1993 | Hendrickson et al. | 241/23 |
| 5,201,839 | 4/1993 | Swisher, Jr. | 366/4 |
| 5,251,976 | 10/1993 | Milstead | 366/18 |
| 5,252,124 | 10/1993 | Brashears et al. | 106/281 |
| 5,294,062 | 3/1994 | Hendrickson et al. | 241/67 |
| 5,335,989 | 8/1994 | Tanaka | 366/25 |
| 5,364,182 | 11/1994 | Hawkins | 366/25 |
| 5,378,060 | 1/1995 | Brock et al. | 366/25 |
| 5,397,177 | 3/1995 | Swisher, Jr. | 366/25 |

FOREIGN PATENT DOCUMENTS

| | | |
|---|---|---|
| 3-63303 | 3/1991 | Japan . |
| 3-235803 | 10/1991 | Japan . |

OTHER PUBLICATIONS

"Rapmaster Plant Designed to Run RAP Mixes Without a Baghouse," *Asphalt Contractor*, Apr., 1995; p. 95.

*Primary Examiner*—Henry A. Bennett
*Assistant Examiner*—Dinnatia Doster
*Attorney, Agent, or Firm*—Woodard, Emhardt, Naughton Moriarty & McNett Patent and Trademark Attorneys

[57] ABSTRACT

A recycled asphalt product (RAP) drying apparatus comprising a three-zone counterflow RAP dryer and a duct system to recycle essentially all of the hot gases back through the system. The three-zone RAP dryer has a combustion zone at one end, a drying zone at the other end, and a buffer zone between the combustion and drying zones. A RAP inlet to introduce RAP into the dryer is included at one end of the drying zone, and a RAP outlet to remove RAP from the dryer is included at the other end of the drying zone. A duct pathway routes hot air from the drying zone back to the buffer zone so that hot air may be recycled through the apparatus.

4 Claims, 2 Drawing Sheets

RECYCLE MOISTURE EVAPORATION SYSTEM

This application is a continuation of application Ser. No. 08/573,198, filed Dec. 15, 1995, now U.S. Pat. No. 5,579,587 allowed Oct. 18, 1996.

FIELD OF THE INVENTION

The present invention relates generally to devices for producing asphaltic product, and more particularly to an apparatus for processing recycled asphalt paving material.

BACKGROUND

For at least the past 15 to 20 years, it has been known to incorporate recycled asphalt pavement (RAP) with various quantities of virgin aggregate material to produce a desirable and consistent blend for resurfacing roads. To produce such blends, the challenge for manufacturers has been to create a production unit that addresses the problems currently associated with the production of RAP, namely: (1) the generation of environmental pollutants; and (2) the production of by-products which adversely affect the life expectancy of the equipment used in the plants. In addition, it is always desirable to design the system so that a minimum amount of energy is required, and production costs are thereby minimized.

The above concerns are particularly significant when RAP is added in percentages of 20% or more. For example, the by-products and pollutants created by combining cold RAP with superheated virgin aggregate causes hydrocarbons and steam which chokes the filtering system of the main plant which in turn wreaks havoc with pressures in the baghouse and static pressure in the combustion chamber resulting in lower production rates.

The superheating of virgin aggregate also creates a volatile situation in drum mix plants because as the higher percentages of recycle are being incorporated into the hot mix asphalt, the virgin aggregate material (VAM) temperature must be raised, often above the flash point of the liquid asphalt cement (AC), in order to reach the job specified mix temperature.

In batch plants the enormous amount of steam created by combining the RAP, the VAM and the liquid AC in the mill may cause an explosion which destroys the properties of the virgin liquid AC while creating hydrocarbons which cannot be recaptured and are thus released into the atmosphere.

Various artisans have attempted to address the problems associated with asphalt recycling facilities. For example, U.S. Pat. No. 4,600,379 to Elliott discloses a drum heating and mixing apparatus having two, concentric drums that heat aggregate material first in the inner drum and then in the space between the inner and outer drums. An exhaust gas outlet duct operatively connects the exhaust gas from the inner drum to the atmosphere, while an exhaust gas feedback siphons gas emitted in the space between the drums for incineration through the system burner. In the Elliott system only some of the hydrocarbons are returned to the drum drying burner so that the volume of steam and hydrocarbons produced by the system is not being totally captured. At higher rates of RAP therefore, the system, if not choked off, will vent into either the atmosphere or the filter house, potentially causing the filter house bags to clog.

U.S. Pat. No. 5,090,813 to McFarland and U.S. Pat. No. 5,201,839 to Swisher each include a step to take at least some of the moisture out of the RAP before it is added to the VAM. A parallel dryer is used with a portion of the area set aside for preheating the RAP. Total air for the system is supplied by one exhaust fan thus gases created by both dryers must pass through the filter house. The area set aside for preheating the RAP is approximately one quarter of the total area of both the RAP and mixing dryer and the counterflow aggregate dryer. Therefore chamber temperatures tend to reach undesirable heights because of the rate at which the RAP drying burner must operate in order to raise the temp of the RAP. Total moisture removed from the RAP cannot be established before introduction of the RAP to the VAM.

U.S. Pat. No. 5,251,976 to Milstead is directly related to RAP being introduced in the Hot Elevator of the batch type plant and a diversion chute booting into designated hot bin #1. The percentages are normally controlled in much the same way a blending control is used on the drum mix type plants. This type of operation limits the contractor of a batch plant to one type of mix at any one time. Unfortunately, both state and federal regulations prohibit this type of mixing method because the segregation of the RAP and VAM cannot be controlled. Also moisture from the RAP causes corrosion of the bins, screens, and the hot elevator in a short period of time.

U.S. Pat. No. 4,540,287 to Servas et al. discloses an apparatus which is used to combine RAP and VAM in a totally separate mixing drum with liquid AC and all hydrocarbons and steam being directed to the main plant burner. Job specified mix temperature is established after mixing has been completed. Problems that have arisen on this apparatus are the ignition or flaming of the mix while trying to achieve desired temperatures; and when attached to a batch plant, again, as with almost all the previously discussed designs, the versatility of changing different types of mixes throughout the day is very limited.

A recent survey regarding asphalt recycling conducted by Future Technology Surveys of Lilburn, Ga., determined that the asphalt manufacturing industry is particularly concerned with: (1) a simple technology which will result in one piece of equipment that meets industry standards for processing recycle for both batch plant and drum mix operations; and (2) operating costs in running recycle. The present invention addresses both of those concerns.

SUMMARY OF THE INVENTION

Briefly describing one embodiment of the present invention, there is provided a recycled asphalt product (RAP) drying apparatus comprising a three-zone counterflow RAP dryer and a duct system to recycle essentially all of the hot gases back through the system. The three-zone RAP dryer has a combustion zone at one end, a drying zone at the other end, and a buffer zone between the combustion and drying zones. A RAP inlet to introduce RAP into the dryer is included at one end of the drying zone, and a RAP outlet to remove RAP from the dryer is included at the other end of the drying zone. A duct pathway routes hot air from the drying zone back to the buffer zone so that hot air may be recycled through the apparatus.

DESCRIPTION OF THE PREFERRED EMBODIMENT

For the purposes of promoting an understanding of the principles of the invention, reference will now be made to preferred embodiments and specific language will be used to describe the same. It will nevertheless be understood that no limitation of the scope of the invention is thereby intended, such alterations and further modifications in the described device, and such further applications of the principles of the invention as illustrated therein being contemplated as would normally occur to one skilled in the art to which the invention relates.

As briefly described above, the present invention is a RAP drying apparatus that operates more efficiently than prior art systems by recycling essentially all of the hot air produced by the burner. The apparatus includes a three-zone RAP dryer (including a combustion zone, a buffer zone and a drying zone) and a duct pathway to route hot air from the drying zone of the RAP dryer back to the buffer zone of the dryer. In one preferred embodiment the duct pathway routes hot air from the drying zone back to the combustion zone before further routing it to the buffer zone of the apparatus.

Figure 1:
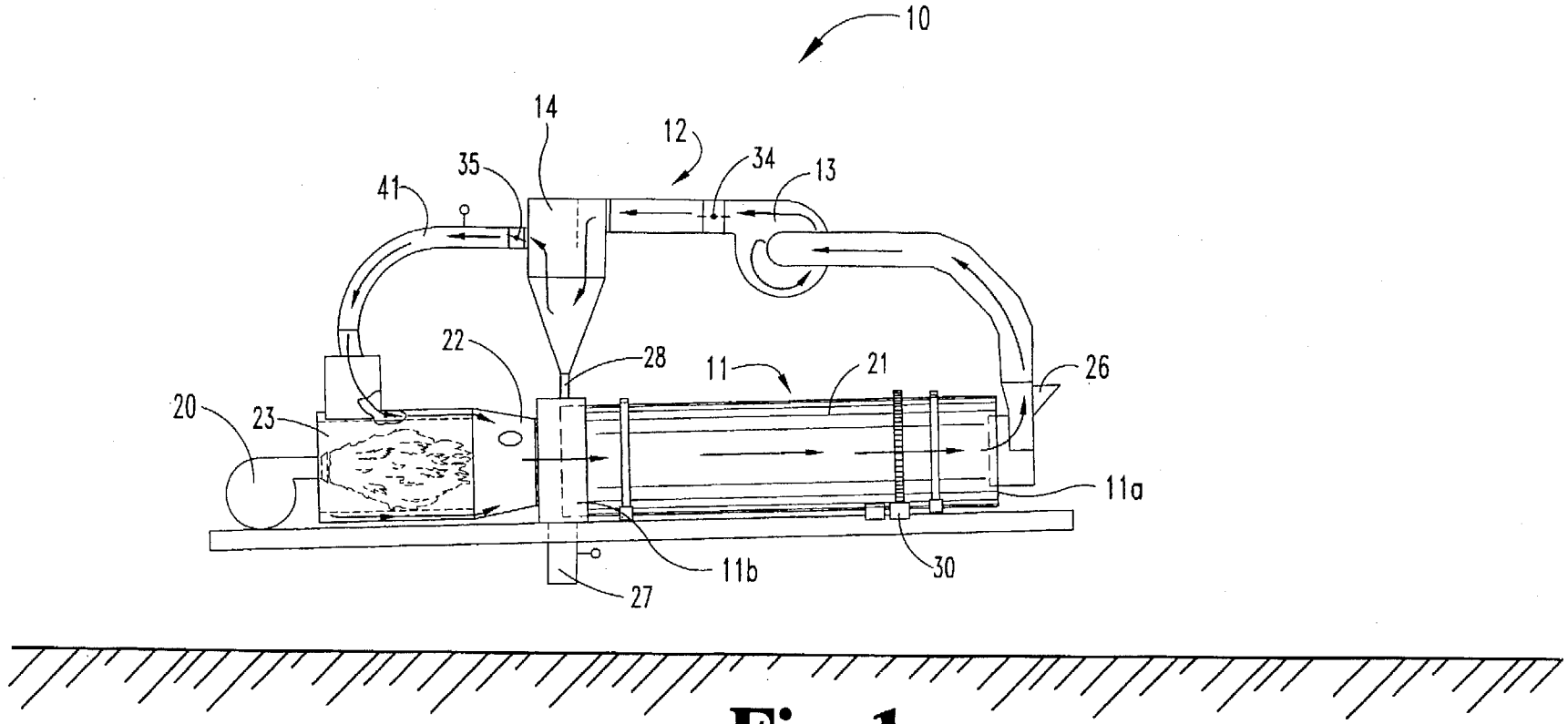
FIG. 1 shows the basic RAP drying apparatus of the present invention, according to one preferred embodiment.

Referring to the drawings, FIG. 1 is a side elevational view of one preferred embodiment of the apparatus of the present invention. As shown in the Figure, RAP drying apparatus 10 includes RAP dryer 11 and duct pathway 12. A booster fan 13 and an inertial separator 14 are preferably included in duct pathway 12.

RAP dryer 11 has two ends, first end 11*a* and second end 11*b*. A drying zone 21 is located at the first end 11*a* of RAP dryer 11, and a combustion zone 23 is located at the second end 11*b*. A buffer zone 22 is positioned between drying zone 21 and combustion zone 23. A combustion burner 20 is provided at the second end 11*b* of the dryer (with the associated flame being confined to combustion zone 23) to provide heat to the dryer.

RAP charging chute 26, RAP discharge chute 27 and trickle chute 28 are also preferably included in the apparatus to facilitate the flow of RAP through the system.

A dryer motor 30 is preferably included to turn drying zone 21. RAP dryer 11 is of the counterflow type, which allows for either a counter clockwise or clockwise rotation. In one preferred embodiment the rotation is clockwise, viewing from the discharging end. The speed of the rotation is controlled by variable speed motor 30, which drives RAP dryer 11 and thereby regulates the rate of RAP flow through the dryer.

During HMA production, both RAP and aggregate dryers will run simultaneously, heating their respective material to desired materials. RAP dryer 11 is fed by a variable speed motor control from a recycle holding bin which shuttles the material up the recycle bin conveyor and assures that the desired amount of recycle necessary to maintain the correct recycle to virgin material mix percentages is dropped into the recycle charging chute 26. The material dropping from recycle charging chute 26 is then received by the RAP dryer veiling flights (not shown) so that the drying process can begin.

Material to be dried is heated by the hot air stream and continually veiled in a counterflow direction through the RAP dryer 11. Upon reaching discharge sweeps, the RAP exits the RAP dryer 11 through RAP discharge chute 27.

The hot air stream utilized in the drying process is created by burner 20, with the flame being contained in combustion zone 23. The hot air stream travels from the combustion zone 23 through buffer zone 22, before heating the RAP in drying zone 21.

After drying the RAP, the hot air is then pulled through duct pathway 12 for recirculation through the system. The hot air stream volume and velocity are controlled by booster fan 13, and by the various dampers preferably included in the system. In particular, dampers 34 and 35 are preferably included in duct pathway 12.

A separator 14 captures any of the "fines" material in the air stream and sends the captured fines through the trickle valve chute 28 into the RAP discharge chute 27, thus blending the fines with the dried recycle before the recycle reaches the dry RAP conveyor.

Once the hot air stream has been purged of fines, it is then diverted to one of two ducts. The majority of the hot air stream passes through the reburn duct 41 back into the stationary buffer zone 22 to be reheated by the RAP combustion burner 20. Because the heat of the hot air stream is retained in RAP dryer 11, the air passing through the reburn duct 41 prevents the stationary combustion zone 23 from reaching the undesirable high temperatures usually associated with stationary combustion zones.

Figure 2:
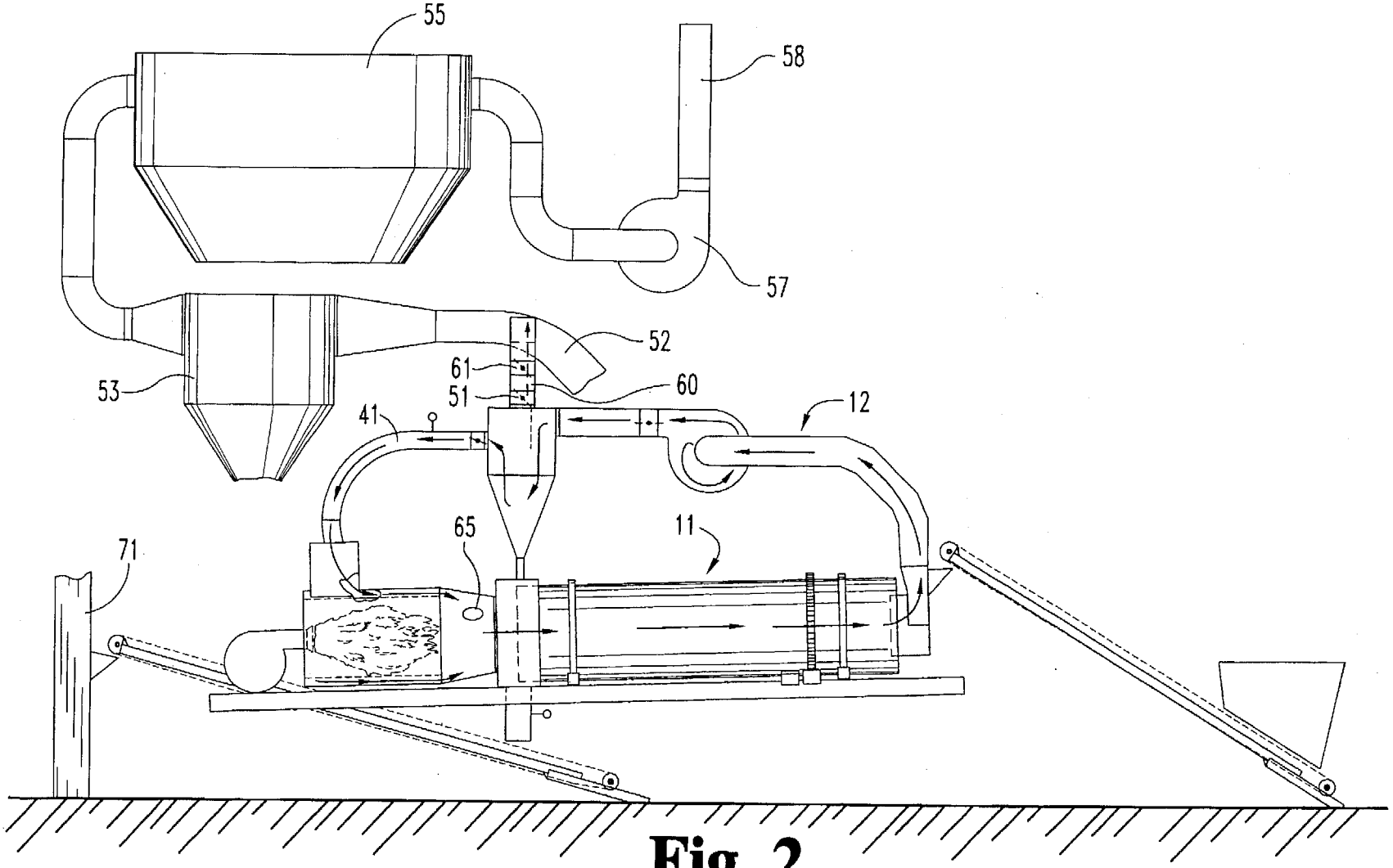
FIG. 2 shows the RAP drying system of the present invention, including the associated components.

FIG. 2 shows certain components of the existing asphalt production facility with which the inventive apparatus is designed to work. For example, main plant duct 52, knock-out box 53, baghouse 55, exhaust fan 57 and exhaust stack 58 are shown. Preferably, the drying apparatus 10 is connected to the main plant equipment by dryer-to-plant duct 60.

If for any reason the hot air stream needs to be pulled at a greater rate, a louver damper 61 controlling the air flow to the main plant can be opened into the vented air stream which is contained in the RAP to main plant duct.

Also contained in the RAP-to-main plant duct is an isolation damper 52 which serves two purposes. First, this damper can be closed to isolate the RAP drying system from the main plant system when RAP is not required for the HMA. Second, in the event that the buffer zone scanners 65 should detect a flame, the isolation damper will automatically close to contain the flame in the RAP drying system.

Any minuscule amount of air that may need to be vented through the RAP to main plant duct will be carried through the main plant duct and processed through the main plant knock out box assuring that any of the RAP fines passing through the RAP to main plant duct are captured and taken to either a return screw conveyor or by pneumatic means to a fines silo. The purged air is taken to a filter house and any minute dust particles are collected on the filters, resulting in clean air being pulled by the exhaust fan and vented through the stack exhaust of the main plant.

The velocity and volume of the hot air stream is controlled automatically by the RAP booster fan louver damper maintaining the RAP dryer pressure as close as possible to positive which in turn creates a much more efficient drying environment than they typical aggregate drying process.

The desired discharge temperature of the finished RAP will be between 170 degrees and 180 degrees. The RAP thermocouple senses the temperature of the RAP discharge chute and sends the temperature reading to an automatic burner control. Should the temperature rise more than 20 degrees above the desired set point, the control will shut down the RAP combustion burner 20 insuring that no undesirable hydrocarbons can be produced and eliminating the chance that the RAP will reach its flash point.

Final product generated by the RAP drying process indicated in FIG. 1 is then taken by the dry rap conveyor and is either blended with the VAM in the RAP chute in the hot elevator and taken by the hot elevator 71 to the top of the batch tower or taken to an intermediate port and blended with the VAM in the designated mixing zone of the drum mix plant to produce the HMA.

As higher percentages of recycle are being incorporated into the HMA, the VAM temperatures must be raised, often times above the flash point of the liquid AC, in order to reach the job specified mix temperature. This invention will keep the virgin aggregate below the flash point while still sustaining the job specified mix temperature.

Further, the present invention will raise the recycle temperature allowing for the lowering of the VAM temperature which will, in turn, not only eliminate the explosion in the batch tower but will also eliminate the production of hydrocarbons.

Finally, the variable speed motor on the RAP dryer cuts down segregation, improving the quality of the mix and allowing deviations in drying time for various sizes and types of recycle.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A recycled asphalt product (RAP) drying apparatus, comprising:

(a) a counterflow RAP dryer having a first end and a second end, said RAP dryer having a combustion zone at its first end, a drying zone at its second end, and a buffer zone between said combustion zone and said drying zone, said drying zone having a first end and a second end, with the first end of the drying zone being nearest the first end of the dryer and the second end of the drying zone being nearest the second end of the dryer, with a RAP inlet to introduce RAP into the drying zone near its second end, and a RAP outlet to remove RAP from the drying zone near its first end and (b) a duct pathway to route hot air from the drying zone back to the combustion zone so that hot air may be recycled through the RAP drying apparatus.

2. A method of drying recycled asphalt product (RAP) comprising:

(a) providing a RAP dryer having a first end and a second end, said RAP dryer having a combustion zone at its first end, a drying zone at its second end, and a buffer zone between said combustion zone and said drying zone;

(b) providing a duct pathway external to said RAP dryer, to route hot air from the drying zone back to the combustion zone;

(c) heating the combustion zone of the RAP dryer;

(d) providing RAP to the drying zone of the dryer;

(e) tumble-drying the RAP in the drying zone by passing hot air from the combustion zone through the buffer zone to the drying zone;

(f) further passing the hot air from the drying zone through the duct pathway and back to the combustion zone.

3. The method of claim 2 wherein substantially all of the hot air is continuously rerouted through the system.

4. A recycled asphalt product (RAP) drying apparatus, comprising:

(a) a counterflow RAP dryer having a first end and a second end, said RAP dryer having a combustion zone at its first end, a drying zone at its second end, and a buffer zone between said combustion zone and said drying zone, said drying zone having a first end and a second end, with the first end of the drying zone being nearest the first end of the dryer and the second end of the drying zone being nearest the second end of the dryer, with a RAP inlet to introduce RAP into the drying zone near its second end, and a RAP outlet to remove RASP from the drying zone near its first end; and (b) a duct pathway to route hot air from the drying zone back to the buffer zone so that hot air may be recycled through the RAP drying apparatus;

wherein at least a portion of said duct pathway to route hot air from the drying zone back to the buffer zone is positioned adjacent to, and in a heat transferring relationship with, said combustion zone.

* * * * *